United States Patent [19]

Luxton

[11] Patent Number: 5,035,183

[45] Date of Patent: Jul. 30, 1991

[54] FRANGIBLE NONLETHAL PROJECTILE

[76] Inventor: David Luxton, 2311 Nerta Street, Ottawa, Canada, K1G 1E6

[21] Appl. No.: 491,697

[22] Filed: Mar. 12, 1990

[51] Int. Cl.[5] ..... F42B 8/14

[52] U.S. Cl. ..... 102/502; 102/506; 102/513; 102/529; 102/447; 273/418

[58] Field of Search ..... 102/395, 444, 447, 498, 102/502, 506, 513, 517, 529; 273/418

[56] References Cited

U.S. PATENT DOCUMENTS

| | | | |
|---|---|---|---|
| 3,028,808 | 4/1962 | Porter et al. | 102/517 |
| 3,144,827 | 8/1964 | Boutwell | 102/466 |
| 3,170,405 | 2/1965 | Jungermann et al. | 102/529 |
| 3,326,133 | 6/1967 | Stadler et al. | 102/529 |
| 3,650,213 | 3/1972 | Abbott et al. | 102/444 |
| 3,785,293 | 1/1974 | Barr et al. | 102/529 |
| 3,865,038 | 2/1975 | Barr | 102/529 |
| 4,742,776 | 5/1988 | Scuto | 102/501 |

FOREIGN PATENT DOCUMENTS

| | | | |
|---|---|---|---|
| 178308 | 4/1954 | Fed. Rep. of Germany | 102/517 |

*Primary Examiner*—Harold J. Tudor

[57] ABSTRACT

A nonlethal frangible projectile for delivering fluids and the like to a target is composed of a soft cap portion, and a stronger base portion which plugs the rearward end of the cap. Scoring and a thinned nose region facilitates rupture upon impact.

6 Claims, 1 Drawing Sheet

FRANGIBLE NONLETHAL PROJECTILE

FIELD OF THE INVENTION

This invention relates to a new form of nonlethal projectile and cartridge casing, adapted for use in firearms. More particularly it relates to a frangible projectile of preferred configuration.

BACKGROUND

In the munitions industry a variety of projectiles have been proposed for permitting delivery of a range of chemical agents for various purposes. These purposes range from marking with a colouring agent, to selective use of designer chemicals for operational purposes such as crowd control and special operations.

There have also been various attempts to produce a frangible projectile for toy guns and for real firearms but none are known to have overcome satisfactorily all the problems that may be encountered. Such problems include:

- stable flight, for accuracy and so the projectile with hit nose-first;
- sufficient strength to withstand the stress of feeding and firing in a firearm yet frangible enough to break upon impact even upon an unrigid surface;
- sufficient sealing so that a filling contained within the projectile does not leak; and
- imperviousness to environmental extremes of cold, heat and moisture.

THE INVENTION

The present invention is a two-piece polymer projectile consisting of an aero dynamically shaped, thin-shelled, frangible cap, adapted to be filled with a flowable substance and sealed with a rear plug. It combines the following features to overcome a number of the problems normally associated with frangible projectiles:

(a) the rear plug is relatively rigid in order to contain the expansive effect of propellant gases;

(b) a recessed compartment in the rear plug contributes to creating a forward centre of gravity for the projectile; and thereby provide a more stable flight;

(c) the barrel rifling is engaged by the projectile in the region of the rear plug only, whereby positive engagement with the barrel rifling imparts spin without bursting the cap portion of the projectile;

(d) the cap itself is isolated from the rifling in the gun barrel by dimensioning the cap fractionally smaller than the gun bore so as to reduce the risk of rupture which could occur from contact with the rifling;

(e) score lines on the forward portion of the cap provide separation of the cap release of the filling on impact;

(f) an indentation region on the nose of the cap facilitates flexing of the score lines for move rapid and efficient bursting of the cap on impact;

(g) complete sealing of the filling compound within the cap is achieved through an integral "O" ring on the plug which mates with an encircling groove within the cap for a snap-on sealing fit;

(h) the score lines extending down the side of the cap do not extend over the plug;

(i) the wall thickness of the cap is selected, in combination with material selection, to resist breakage from lateral impact or handling, while remaining sufficiently frangible on impact so as to be nonlethal.

Preferably the projectile is provided with an amorphous free-flowing powder, liquid or semi-liguid filling compound which:

(i) does not significantly change its physical properties over a temperature range of approximately −20 degrees to plus 50 degrees Celsius; and (ii) is of sufficient viscosity and/or adherence to the wall of the projectile cap to prevent the otherwise destabilizing effect of the compound spinning at a different rate from the cap.

These and further features of the invention will be apparent from the description of the preferred embodiments which now follow.

DESCRIPTION OF THE PREFERRED EMBODIMENT

Figure 1A:
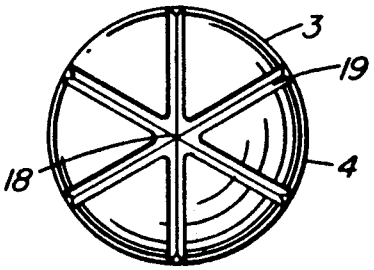
FIG. 1*a*—is an end view of FIG. 1.
Figure 1:
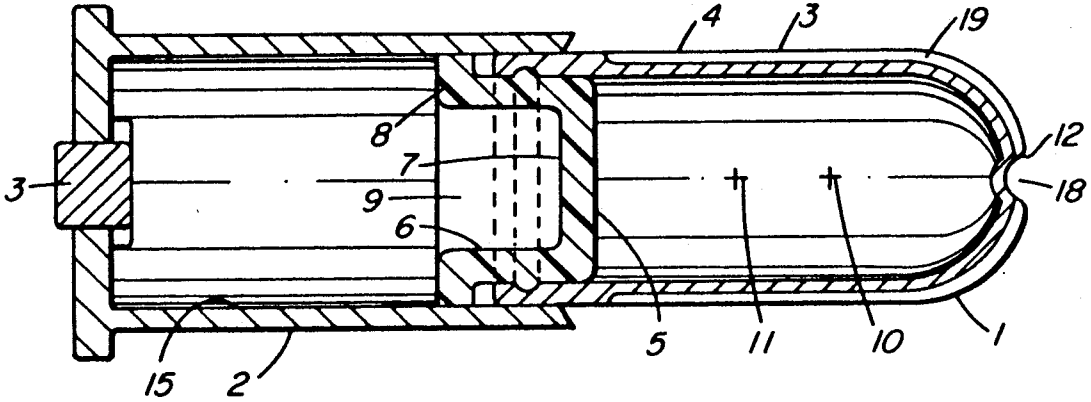
FIG. 1—is a transverse sectional view of a cartridge casing with projectile.
Figure 3:
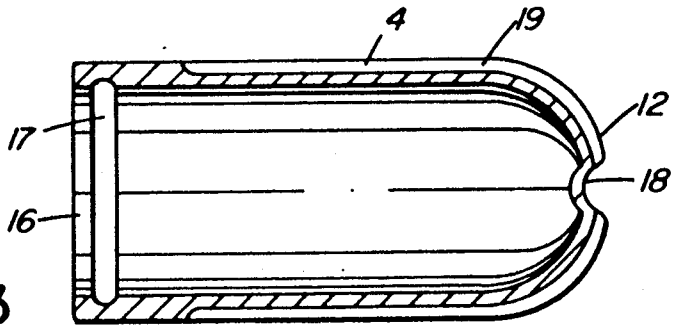
FIG. 3—is a transverse sectional view of the cap or casing portion of the projectile.
Figure 2:
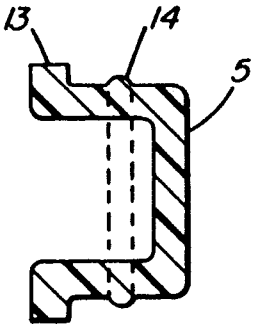
FIG. 2—is a transverse sectional view of the plug or base portion of the projectile.

FIG. 1 shows a projectile, of the type of the invention, inserted into a cartridge casing (2). The cartridge casing is provided with a lower energy propellant means, which may be in the form merely of the standard percussion cap (3). Alternately, a low power gas-generating propellant (not show) may be provided.

The projectile has a forward cap portion (4) and a base or plug (5) which serves to plug the open base region of the cap (4). The plug (5) is provided with an cylindrical portion (6) and a bas (7) which serves as a plate to seal the base of the cap (4).

The base (7) is forward of the rearward end (8) of the plug, providing a cavity (9) therebetween. This cavity (9) shifts the center of mass (10) of the projectile (1) forward of its geometric center (11), midway between the nose (12) of the projectile (1) and the rearward end (8) of the plug (5). This provides stability for the projectile (1) in flight.

The plug (5) is preferably made of a thickness and of relatively ridged polymerić material. Polyethylene has been found satisfactory. The plug (5) serves the function of containing the expansive forces of expanding propellant gas, and must be constructed accordingly.

In detail, as shown in FIG. (2), the plug (5) may be formed with an outer stiffening annular rim (13). Further, it may be provided with an annular coupling ridge (14) capable of providing "O" ring type sealing with the cap.

The diameter of the rim (13) may optionally be such as to provide a tight friction fit with the inner surface (15) of the casing (2). The diameter of this rim may also provide a sliding fit with the inner surface of the barrel of the firearm in which it is to be discharged (not shown). This will permit the ring (13) to engage the rifling on the inside of the barrel and impart longitudinal rotation of the projectile.

The cap (4) is formed of relatively pliable, resilient material in the form of a thin shell or casing. The dimensions and material of the cap (4) are such as to render it susceptible to immediate rupture on impact. A wall thickness of 0.025 inches in polyethylene has been found satisfactory.

The cap (4) is generally cylindrical with an aerodynamic, bullet-shaped nose (12). The base region (16) of the cap (4) makes a tight friction fit with the cylindrical portion (6) of the body of the plug (5). Preferably, the inner surface of the cap (5) is provided with a groove (17) which is complementary to the ridge (14) on the plug (5). Alternately the ridge (14) and groove (17) may be reversed.

The outside diameter of the cap (4) when fitted over the cylindrical portion (16) and ridge (14), as assembled may, along with the entire cap (5), be of a smaller diameter than the rim (13). This will reduce the wear on the cap (5) due to contact with the barrel if the rim (13) provides a tight sliding fit with the barrel.

Alternately, the cap (7), when placed over the cylindrical portion (16), optionally by the stretched fit, may exceed the diameter of the rim (13) sufficiently to engage the rifling in a barrel and impart longitudinal rotation to the projectile (1). In either case, the barrel rifling is positively engaged by the projectile (1) in the region of the rear plug only.

The cap (4) is provided with narrow longitudinal strips of thinned cross-section. These "scores" (19) do not cut entirely through the cap (4), but render it easily burst upon compression by the forces of impact. At the same time the projectile must be sufficiently sturdy to sustain loading, and firing, without bursting. A wall thickness at the scores (17) of 0.005 inches in polyethylene has been found satisfactory.

The scores (19), numbering 6 in the preferred embodiment, are preferably symmetrical positioned about the axis of the cap (4), closing radially at the nose (12) to a depressed central region (18). This depressed region (18) is similarly thinned as the scored regions (19) of the cap (4). It covers a relatively minor portion of the end profile of the cap (4) at its nose end (12) and is prferably, but optionally slightly concave. Its purpose is to facilitate flexing of the score lines on impact, thus providing for more rapid and efficient busting of the cap on impact.

The scores (19) preferably do not extend over the region of the "O" ring ridge (14).

The contents of the projectile may include a powder, gas liquid, semi-liquid or other free-flowing fluid. The use of such a filling in conjunction with modest propellant charges, renders the projectile nonlethal.

Thus, it will be seen from the foregoing that an improved nonlethal, frangible projectile is provided that may be fired from a standard fiream.

These and further features of the invention in its broadest and more narrow aspects are further described and claimed in the claims which follow.

I claim:

1. A two-piece cylindrical projectile for firing from a firearm by a propellant-charged cartridge, such projectile comprising:

(a) an aerodynamically shaped thin-walled, frangible cap portion having:

(i) a closed nose end carrying a free-flowing filling;

(ii) an open base end; and (iii) a surrounding wall that is sufficiently strong to sustain loading and firing, but sufficiently frangible to burst on impact without causing lethal injury, the wall of the cap portion being provided with multiple longitudinal scoring lines which close radially at the nose end and terminate centrally on said nose end with a region wherein the cap wall is relatively reduced in thickness with respect to the wall thickness between the longitudinal scoring lines; and (b) a plug portion of cylindrical proportions, sealingly installed and protruding into the base end of said cap portion, said plug portion being provided with a cylindrical wall to contain the expansive effect of propellant gases on firing, and being provided with an interior cavity within such cylindrical wall, the cavity being of a dimension that causes the center of gravity of the projectile to be displaced forwardly of the geometric, longitudinal mid-point of the projectile.

2. A projectile as in claim 1 wherein said scoring lines extend from the nose end of the projectile towards the base end, terminating at a location along the side of said cap portion that does not over-lie the plug.

3. A projectile as in claim 1 wherein the plug is provided with an outer rim that is of a diameter which will engage with the rifling within a barrel sized to receive the projectile.

4. A projectile as in claim 1 wherein said cap and plug are inter-engaged by means of a complimentary "O" ring type ridge and corresponding groove.

5. A projectile as in claim 2 wherein the plug is provided with an outer rim that is of a diameter which will engage with the rifling within a barrel sized to receive the projectile.

6. A projectile as in claim 2 wherein said cap and plug are inter-engaged by means of a complimentary "O" ring type ridge and corresponding groove.

* * * * *